United States Patent [19]

Doessel et al.

[11] Patent Number: 4,654,283

[45] Date of Patent: Mar. 31, 1987

[54] ELECTROPHOTOGRAPHIC RECORDING MATERIAL HAVING A PHOTOCONDUCTIVE DOUBLE LAYER, AND PROCESS FOR ITS MANUFACTURE

[75] Inventors: Karl-Friedrich Doessel, Wiesbaden; Juergen Lingnau, Mainz, both of Fed. Rep. of Germany

[73] Assignee: Hoechst Aktiengesellschaft, Frankfurt am Main, Fed. Rep. of Germany

[21] Appl. No.: 640,994

[22] Filed: Aug. 14, 1984

[30] Foreign Application Priority Data

Aug. 16, 1983 [DE] Fed. Rep. of Germany ..... 3329441

[51] Int. Cl.[4] ..... G03G 5/14

[52] U.S. Cl. ..... 430/57; 430/64; 430/133

[58] Field of Search ..... 430/83, 81, 57, 58, 430/64, 133, 129

[56] References Cited

U.S. PATENT DOCUMENTS

| | | | |
|---|---|---|---|
| 3,814,600 | 6/1974 | Contois | 430/61 |
| 4,226,928 | 10/1980 | Nakazawa et al. | 430/81 |
| 4,499,167 | 2/1985 | Sano | 430/83 |

FOREIGN PATENT DOCUMENTS

| | | |
|---|---|---|
| 2237539 | 2/1974 | Fed. Rep. of Germany . |
| 3026653 | 1/1981 | Fed. Rep. of Germany . |
| 3108618 | 1/1982 | Fed. Rep. of Germany . |
| 3202552 | 8/1982 | Fed. Rep. of Germany . |
| 3110960 | 9/1982 | Fed. Rep. of Germany . |

*Primary Examiner*—John L. Goodrow

*Attorney, Agent, or Firm*—Schwartz, Jeffery, Schwaab, Mack, Blumenthal & Evans

[57] ABSTRACT

Disclosed is an electrophotographic recording material comprising a photoconductive double layer disposed on an electrically conductive support, which double layer comprises a precoat layer and a photoconductor-containing topcoat layer. The interface region of the precoat and topcoat layers defines a mixing zone into which one or more of the constituents of the separate layers have diffused. A process for producing the electrophotographic recording material is also disclosed.

32 Claims, 4 Drawing Figures

ELECTROPHOTOGRAPHIC RECORDING MATERIAL HAVING A PHOTOCONDUCTIVE DOUBLE LAYER, AND PROCESS FOR ITS MANUFACTURE

BACKGROUND OF THE INVENTION

The present invention relates to an electrophotographic recording material comprising an electrically conductive support, an optional insulating barrier layer, and a photoconductive double layer comprising a layer which generates charge carriers and a charge transport layer, which double layer contains an organic photoconductor, a binder, a dye, and, optionally, conventional additives. The present invention further relates to a process for the manufacture of the aforementioned electrophotographic recording material.

The use in electrophotographic recording materials of photoconductive layers which are composed of a photoconductor and a material acting as a binder is disclosed in U.S. Pat. No. 3,121,006. Binder layers are described which contain finely divided particles of a photoconductive inorganic compound, dispersed in an electrically insulating organic binder. The binder is a material which is incapable of transporting charge carriers generated by the photoconductor particles over a significant distance. Consequently, the photoconductive pigment particles within the layer must be in virtually continuous contact to enable the charges to be conducted away. Conductivity or charge transport is provided by a high concentration of the photoconductive pigment. With such a layer structure, a pigment concentration of more than 50 percent by weight is required.

It has also been disclosed (German Offenlegungsschrift No. 2,108,992, corresponding to U.S. Pat. No. 3,904,407) to produce photoconductive layers for electrophotographic recording materials in a double-layer arrangement. The disclosed material is composed of an electrically conductive support, a layer generating charge carriers, and a charge transport layer. The layer generating charge carriers can then comprise a dispersed pigment. If an insulating binder is used together with the dispersed pigment, a volume concentration of at least 25% of pigment is necessary. The ratio of the layer thicknesses of the charge transport layer and the layer generating charge carriers is 2:1 to 200:1.

It has also been disclosed (German Offenlegungsschrift No. 2,160,812, corresponding to U.S. Pat. No. 4,026,704) to provide photoconductive layers comprising a top layer and bottom layer, both of which contain a binder and the same organic photoconductor, the bottom layer additionally containing at least one activating sensitizer in a quantity of 1 to 20 percent by weight, relative to the total photoconductor content. The disclosed top layer comprises a binder and up to 50% by weight of photoconductor. The indicated layer thicknesses are 0.1 to 5 μm for the bottom layer and 5 to 20 μm for the top layer.

In order to improve the resolution of images obtained by an electrophotographic method, it has also been disclosed (U.S. Pat. No. 3,533,783) to use photoconductive layers which, in a bottom layer, contain an inorganic or organic photoconductor together with an activator, such as a pyrylium salt, and contain a photoconductor and binder in the top layer. The indicated thicknesses of the layers are generally 2.5 to 25 μm.

German Offenlegungsschrift No. 3,108,618 (corresponding to U.S. Pat. No. 4,340,658) describes a three-layer photoreceptor in which a pigment concentration of 50 to 95 percent by weight in the binder employed is necessary.

It has also been disclosed (German Pat. No. 1,117,391, corresponding to British Pat. No. 944,126) to use photoconductive, low-molecular organic compounds for the manufacture of printing plates by an electrophotographic method and to sensitize these compounds in the visible region of the spectrum by means of suitable dissolved dyes (corresponding to German Offenlegungsschrift No. 2,526,720, equivalent to U.S. Pat. No. 4,063,948). In place of the low-molecular substances, polymeric photoconductors together with an activator can also be used (German Offenlegungsschrift No. 2,726,116).

A disadvantage of the known electrophotographic recording materials with a binder, organic photoconductor and dye or pigment is their relatively unsatisfactory resolution, which manifests itself especially when a latent image charged at negative polarity is developed with a liquid developer. Individual lines of a line width below 60 μm then form an image of only reduced contrast, and lines of under 40 μm line width form no image at all. These resolution losses also occur in the case of correspondingly fine screen dots. A further disadvantage is the relatively high content of photoconductor. Thus, in order to obtain an adequate light sensitivity, the photoconductive layers must contain the organic photoconductor in a total concentration of 40 to 50 percent by weight, in addition to the insulating binder, and this manifests itself in considerably increased costs of the materials.

In the manufacture of printing forms by an electrophotographic method, it is also important that the organic photoconductors are insoluble in aqueous-alkaline decoating solutions. Decoating, such as is necessary in the case of use for printing plates and printed circuits, is therefore also impeded by these components. Moreover, the insoluble fractions deposit on rolls, pumps and other components in the decoating apparatus and cause increased maintenance costs.

Since, in the known double-layer materials, the transport layer with its large fraction of photoconductor is also thicker than the layer which generates charge carriers, the disadvantages described above also occur in such materials. Photoconductor double layers, for example, according to German Offenlegungsschrift No. 2,108,992, which are applied in 4 μm thickness to an aluminum support, give charge capacities which are inadequate for use in practice. Satisfactory results are obtained only with layer weights of more than 10 g/m$^2$, with considerable expense of material. A final disadvantage is that dye or pigment particles from the large fraction in the layer generating charge carriers, since they are in contact with the metallic substrate which is the support, become embedded in the pores of the surface, from which they are not removable later. Printing plates produced in this way scum on printing and are virtually useless.

SUMMARY OF THE INVENTION

It is therefore an object of the present invention to provide a high resolution electrophotographic recording material which is capable of high resolution, which has a high light sensitivity coupled with the smallest possible fraction of organic photoconductor, and which is especially suitable for use in the production of printing plates or printed circuits.

It is another object of the present invention to provide an electrophotographic recording material which can readily be charged at low layer thicknesses and which provides a contrast-rich toner image.

It is a further object of the present invention to provide a photoconductor layer which can readily be decoated and which allows the production of printing plates or printed circuits even on metallic substrates, such as copper surfaces, which could hitherto be utilized only with technical difficulties.

It is yet another object of the present invention to provide a process for producing an electrophotographic recording material comprising a mixing zone, which particularly promotes the generation of charge carriers, at the interface of the precoat and topcoat layers of the recording material.

In accomplishing the foregoing objects, there has been provided, in accordance with the present invention, an electrophotographic recording material comprising an electrically conductive support and, disposed on said support, a photoconductive double layer which comprises a precoat layer and a topcoat layer adjacent to said precoat layer, said precoat layer comprising a first insulating binder, and said topcoat layer comprising a second insulating binder which contains (i) between about 25 and about 60 percent by weight of at least one photoconductor and (ii) between about 0.5 and about 20 percent by weight of said dye material, relative to said topcoat layer, wherein the interface region of said precoat layer and said topcoat layer defines a mixing zone into which at least one of said photoconductor and said dye material has diffused. In one preferred embodiment, the ratio of the thickness of said precoat layer to the thickness of said topcoat layer is between about 3:1 and about 1:10.

In accordance with another aspect of the present invention, there has been provided a process for producing an electrophotographic recording material, comprising the steps of (A) applying to an electrically conductive support a precoat layer comprising a first insulating binder and (B) applying to said precoat layer a topcoat layer comprising a second insulating binder which contains (i) between about 25 and about 60 percent by weight of at least one photoconductor and (ii) between about 0.5 and about 20 percent by weight of dye material, relative to said topcoat layer, such that partial redissolution of said precoat layer occurs to form at the interface region of said precoat and topcoat layers a mixing zone into which at least one of said photoconductor and said dye material has diffused.

In a preferred embodiment, the second layer is subjected to drying carried out in at least a first stage and a second stage which differ in temperature or duration, or temperature and duration, both of the first and second stages having (i) a temperature ranging from about room temperature to about 130° C. and (ii) a duration between about 5 and about 30 seconds.

Other objects, features, and advantages of the present invention will become apparent from the following detailed description. It should be understood, however, that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE INVENTION

The recording materials of the present invention can, in the case of positive charging, meet stringent demands and provide high resolution, while the photoconductor concentration, relative to the double layer, is kept relative low. When the recording material of the present invention is used for printing purposes, the high fraction of binder in the precoat ensures rapid decoating. At the same time, the low photoconductor fraction leads to improved technical feasibility of the process. Because the dye is in the topcoat, the embedding of particles in the pores of the support surface is also prevented. Even at low layer weights of the photoconductive double layer, the technically required charge values can be reached with the recording material of the present invention. This is true even when materials, such as copper, which hitherto presented difficulties during charging, are used as the support.

Figure 1:
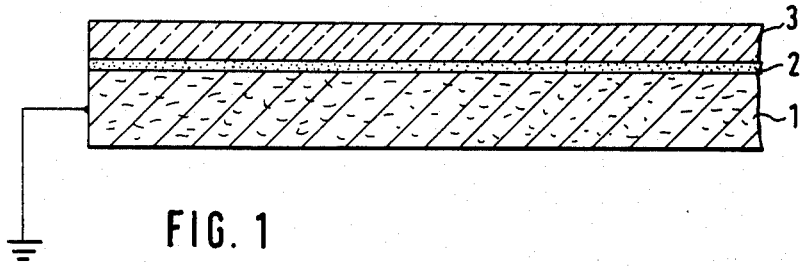
FIGS. 1 and 2 depict in schematic form two different electrophotographic recording materials within the present invention.
Figure 2:
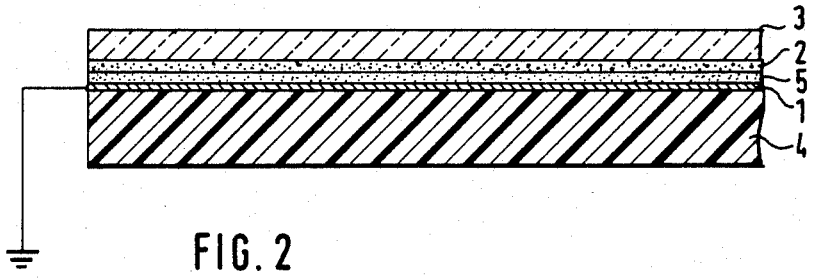

The structure of the electrophotographic recording material according to the present invention is shown diagrammatically in FIGS. 1 and 2. FIG. 1 shows a material which is composed of an electrically conductive support 1, a precoat 2 and a topcoat 3. In FIG. 2, a metallized plastic film (1, 4) is provided as the support to which an insulating barrier layer 5 is applied. The photoconductive double layer is provided on barrier layer 5.

As the electrically conductive support 1, (FIG. 1) materials like those which have also been used before for this purpose, having sufficient electrically conductive properties, are suitable. The support can be in the form of a drum, a flexible belt or a plate. In a preferred embodiment, the support is suitable for the production of printing forms and printed circuits and is comprised of, for example, an aluminum, zinc, magnesium, copper, iron, nickel, or multi-metal plate. Metallized plastic films, for example plastic films with vapor-deposited metal, such as polyester films with vapor-deposited aluminum, or copper-laminated polyimide films and plates, can also be used.

Surface-modified supports of aluminum have proved particularly suitable. The surface modification comprises mechanical or electrochemical roughening and, if appropriate, subsequent anodizing and treatment with polyvinylphosphonic acid according to German Offenlegungsschrift No. 1,621,478, corresponding to U.S. Pat. No. 4,153,461 the contents of which are incorporated herein by reference. The barrier layer thus obtained is denoted as layer 5 in FIG. 2. Generally, a thermally, anodically or chemically produced metal oxide layer, for example, of alumina, can be used as the barrier layer. The barrier layer has the object of reducing or preventing the injection of charge carriers from the electrically conductive support in the dark into the photoconductive layer. On the other hand, however, it must not impede the charge flux during the exposure step. In addition, the barrier layer promotes adhesion of the subsequent layers to the support. Various natural or synthetic resin binders, which have good adhesion to a metal or aluminum surface and do not undergo dissolution or detachment during subsequent application of the further layers can be used for organic barrier layers. The thickness of the organic barrier layer is in the region of 1 μm, and that of a metal oxide layer is on the order of 10 to $10^3$ nanometers.

For the production of, for example, printed circuits, such as are commonly used in electronics, the photoconductive double layer (2, 3) can also be applied initially to a temporary support (not shown), from which it is subsequently transferred as a so-called dry resist to the support 1 or (1, 4). This can be effected, for example, by lamination. Plastic films, such as those of polyester, particularly of polyethylene terephthalate, have proved particularly suitable as temporary supports. The polarity of the charging of laminated layers enables positively controlled dry developers or liquid developers to be used in the production of printed circuits.

The layer 2 comprises a highly insulating binder or binder mixture. Binders which are suitable with respect to flexibility, film properties, and adhesive strength are natural and synthetic resins which can be partially redissolved in or swollen by conventional solvents or solvent mixtures during the production of the layers. These include polyester resins which represent mixed polyesters of isophthalic and terephthalic acid with glycols. Silicone resins have also proved to be suitable. Polycarbonate resins can readily be employed. Those binders are particularly preferred for the production of printing forms and printed circuits which are soluble in aqueous or alcoholic solvent systems, if appropriate with the addition of acid or alkali. For physiological and safety reasons, aromatic or aliphatic, highly flammable solvents must be ruled out. Accordingly, suitable resin binders are high-molecular substances which carry side groups conferring solubility in alkali. Examples of such groups are acid anhydride groups, carboxyl groups, carboxylic acid amide groups, phenol groups, sulfonic acid groups, sulfonamide groups or sulfonamide groups. Preferably, resin binders with high acid numbers are employed. Copolymers with anhydride groups can be used very successfully, since their conductivity in the dark is low due to the absence of free acid groups, despite good solubility in alkali. Copolymers of styrene and maleic anhydride, sulfonyl-urethanes according to German Offenlegungsschrift No. 3,210,577, and copolymers of acrylic or methacrylic acid have proved particularly suitable.

To control the quality of coating during the application of the precoat, it has proved advantageous to dye the layer with a dye material, in small quantities up to about 0.5 percent by weight, relative to the precoat layer. The dyes used for this purpose can be either the sensitizing dyes used in the topcoat or dyes devoid of sensitizing properties.

Layer 3 contains at least one dye. The dye can be present in the layer either as a solution or as a dispersion in the binder. The compounds are known. These include in particular dyes from the group comprising perylene-3,4,9,10-tetracarboxylic acid derivatives according to German Pat. No. 2,237,539, corresponding to U.S. Pat. No. 3,871,882; metal-containing phthalocyanines according to, for example, German Offenlegungsschrift No. 3,245,673; perinones according to German Auslegeschrift No. 2,239,923, corresponding to British Pat. No. 1,416,603, and/or fused quinones, according to German Auslegeschrift No. 2,237,678, corresponding to U.S. Pat. No. 4,315,981. Soluble dyes which can be used are rhodamine dyes, cyanine dyes, and triarylmethane dyes.

Preferably, N,N'-dimethylperylene-3,4,9,10-tetracarboxylic acid diimide (C.I. 71,130), copper-containing phthalocyanine (C.I. 74,160), Hostaperm Orange GR (C.I. 71,105), and/or Hostaperm Scarlet GO (C.I. 59,300) are used as the dye. Soluble dyes are preferably dyes such as Rhodamine B (C.I. 45,170), Astrazone Orange R (C.I. 48.040), and/or Brilliant Green (C.I. 42,040).

The layer 3 also contains at least one photoconductive organic compound. Particularly suitable compounds are those which possess an extensive $\pi$-electron system. These include monomeric heterocyclic compounds which are substituted by dialkyl-substituted amino groups or alkoxy groups. Heterocyclic compounds, such as oxadizole derivatives mentioned in German Pat. No. 1,058,836, corresponding to U.S. Pat. No. 3,189,447, have proved particularly suitable. Triphenylamine derivatives, oxazole, pyrazoline, triazole and imidazole derivatives, such as are disclosed, for example, from German Pat. Nos. 1,120,875, 1,060,260, and 1,060,714 (corresponding to U.S. Pat. Nos. 3,257,203, 3,112,197, and 3,180,729, respectively) are also included here. Hydrazone compounds, such as are mentioned, for example, in German Offenlegungsschrift No. 2,919,791, corresponding to U.S. Pat. No. 4,278,747, can also be employed. Preferably 2,5-bis-(4'-dialkylaminophenyl)-1,3,4-oxadiazole, p-methoxybenzaldehyde diphenyl hydrazone and/or 1,5-diphenyl-3-p-methoxyphenyl pyrazoline are used.

The binders used for layer 3 are generally the same as those described above for the precoat.

As conventional additives, the layers contain substances which are added to the coating solution to improve surface structure and flexibility. For example, these can be plasticizers, such as triphenyl phosphate, or levelling agents, such as silicone oils.

In the boundary region of the precoat and topcoat, there is a zone where substances from both layers are mixed. This zone is obtained essentially as a result of layer constituents, in particular photoconductors, passing by diffusion during the application of the second layer into the layer applied first. To avoid so-called "poisoning" phenomena on metallic substrates like copper or iron, the thickness of the precoat must exceed the thickness of the mixing zone. From the appearance of these "poisoning" phenomena caused by an interaction of the metallic surface and the photoconductor—at a thickness of layer 2 of about 2 μm—a of the mixing zones within a range of about 1.5–2 μm can be assumed by analogy.

The total layer thicknesses of the photoconductive double layer are in the range between about 5 and about 25 μm. In the case of use for printing plates, the total layer thickness is preferably in the range from about 4 to 10 μm. In the case of use for printed circuits, the total layer thicknesses are in the range from about 6 to about 50 μm.

The present invention also relates to a process for producing the electrophotographic recording material according to the invention, in which process the photoconductive double layer is applied to the electrically conductive support. The process comprises applying the coating solution or dispersion of the precoat and drying or incipiently drying it and then coating the coating solution or dispersion of the topcoat on top and drying it with the result of partially redissolving or swelling the preceding layer. Preferably, the drying of the double layer is carried out in stages with respect to duration and temperature. The duration of the individual stages is within the range from about 10 seconds to a few minutes. The drying temperature is in the range from room temperature up to 130° C. A process has proved particularly advantageous in which drying of the applied solutions or dispersions is carried out in stages within the range from room temperature to 130° C. for periods from 5 to 30 seconds.

As a result of the process of the present invention, within the boundary region of the surfaces of the precoat and topcoat, respectively a mixing zone of the constituent substances is obtained, having a thickness of about 1.5 to about 2 μm, which zone particularly promotes the generation of charge carriers.

The solvents or solvent mixtures used for the coating solution have boiling points which allow drying within the conventional industrial range, have good solution properties for photoconductors and binders, and do not pollute the environment. These include lower alcohols, lower ketones and ethers, and esters. Examples of suitable solvents include tetrahydrofuran, acetone, methylglycol and butyl acetate. It has been found that quickly drying coating solutions or dispersions advantageously contain tetrahydrofuran as the solvent.

During the drying process, according to the invention, the step of partially redissolving the layer first applied takes place initially at a relatively low temperature. Subsequently, drying takes place, preferably in a stepwise fashion, in the temperature range from about 80° to about 120° C.

The coatings are applied in the conventional manner, for example, by blade application or by spraying. Preferably, application is effected with a flow-coater. Drying of the layers is carried out, for example, in drying tunnels, the various drying stages being fixed by the temperature of the individual zones, by the running speed of the material, and by the air rate used.

The invention is explained in more detail by reference to the following examples and comparison examples.

EXAMPLE 1

The following solution was coated on a 300 μm thick, anodically oxidized aluminum printing plate support, in such a way that a layer weight of 3 g/m² was obtained after drying:

100 g of a copolymer of styrene and maleic anhydride, decomposition point 200° to 240° C., were dissolved in 900 g of tetrahydrofuran with the addition of 0.1 g of silicone oil of viscosity 5 to 20 mPa·s.

With the following dispersion, a topcoat was then applied on top of the above-described precoat:

50 g of a copolymer of styrene and maleic anhydride and 50 g of 2,5-bis-(4'-diethylaminophenyl)-1,3,4-oxadiazole were dissolved in 700 g of tetrahydrofuran and 200 g of butyl acetate, with the addition of 0.1 g of silicone oil.

4 g of N,N'-dimethylperylene-3,4,9,10-tetracarboxylic acid diimide (C.I. 71,130) were dispersed in this solution within 2 hours by grinding in a ball mill.

The liquid topcoat was dried for about 20 seconds at room temperature, then for 30 seconds at 60° C., and subsequently for about 120 seconds at 110° C. Under these conditions, partial redissolution of the precoat occurred and a defined mixing zone between the two layers was obtained. Application of the topcoat was adjusted in such a way that the total layer weight of the double layer was 6 g/m², corresponding approximately to a thickness of 6 μm.

Figure 3:
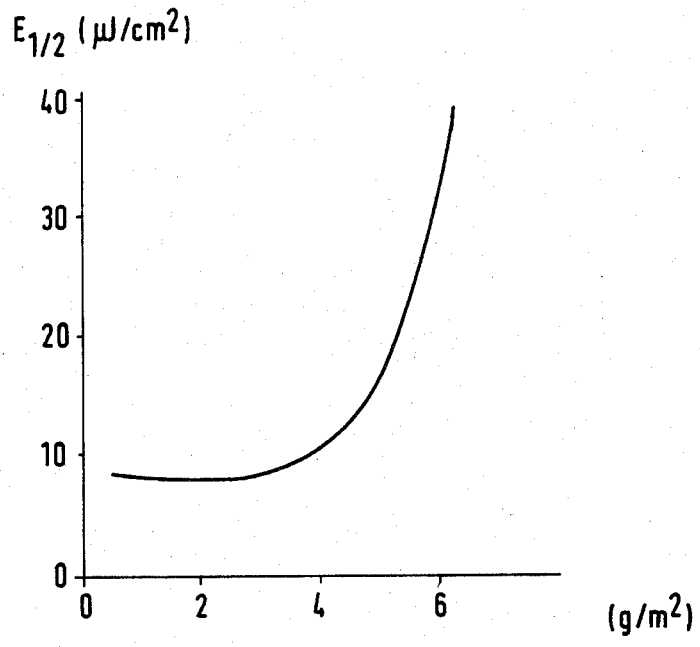
FIG. 3 shows a graph in which the sensitivity of an electrophotographic recording material within the present invention is plotted as a function of the weight of the precoat layer.

The coating procedure was then repeated, with the total layer weight of 6 g/m² being retained, but with the layer thickness of the precoat being varied between 0.5 and 5.5 g/m². The corresponding ratio of thicknesses of the precoat to the topcoat is in the range of about 1:10 to about 10:1. Dependence of the recording materials sensitivity on the thickness of the precoat is shown in FIG. 3 where the energy required for discharge to $E_{\frac{1}{2}}$ (half the original charge) is plotted as a function of the layer weight of the precoat, with a maximum layer weight of 6 g/m². From FIG. 3, it is evident that good results were obtained in the ratio range from about 1:10 to about 3:1.

In spite of their low content of organic photoconductor, the double layers prepared in this way were distinguished by a high light sensitivity in positive charging and by very good resolution. Demonstrative data concerning sensitivity and resolution are presented in Table 1, where the $E_{\frac{1}{2}}$ values relate to exposure with halogen lamps through heat protection filters.

In a printing test, the printing plate obtained after the steps of imaging, developing with a commercially available liquid developer, fixing, and decoating in accordance with German Auslegeschrift No. 1,117,391 gave a run of more than 100,000 prints; the 20 μm lines in the K field of the PMS wedge were reproduced.

EXAMPLE 2

(Comparison example)

The procedure followed was that used in Example 1, with the difference that, in the precoat, a mixture of 50% of binder and 50% of 2,5-bis-(4'-diethylaminophenyl)-1,3,4-oxadiazole was used instead of the pure binder. Despite the markedly higher proportion of photoconductor, the recording material thus obtained had, compared with the material of Example 1, only an insignificantly higher sensitivity, coupled with clearly poorer decoating properties.

EXAMPLE 3

(Comparison example)

2 g of N,N'-dimethylperylene-3,4,9,10-tetracarboxylic acid diimide were dispersed by grinding for 2 hours in a ball mill in a solution of 75 g of a copolymer of styrene and maleic anhydride and 25 g of 2,5-bis-(4'-dimethylaminophenyl)-1,3,4-oxadiazole in 900 g of tetrahydrofuran, with the addition of 0.1 g of silicone oil.

The layer was applied to an anodized aluminum printing plate support as in Example 1 in such a way that, after drying, a layer weight of 6 g/m² was obtained.

The composition of the layer corresponded to the combination of 3 g/m² of precoat and 3 g/m² of topcoat from Example 1. The light sensitivity (E) was reduced as compared with the double layer from Example 1, and the resolution of the images produced on this layer is markedly poorer than that on the double layer of Example 1. In the K field of the PMS wedge, no reproduction of the 40 μm lines was obtained.

TABLE 1

| Example | Charging (V) | $E_{\frac{1}{2}}$ (μJ/cm²) |
|---|---|---|
| 1 | +600 | 6.6 |
| 2 (comparison) | +600 | 6.2 |
| 3 (comparison) | +600 | 9.5 |
| 4 | +550 | 11.0 |
| 6 | −600 | 6.0 |
| 7 | −600 | 7.2 |
| 8 (comparison) | −800 | 43.8 |
| 9 | +400 | 8.0 |
| 10 (comparison) | +450 | 5.4 |
| 11 | +400 | 7.2 |
| 12 | +400 | 8.6 |
| 13 (comparison) | +400 | 9.0 |

EXAMPLE 4

The coatings of Example 1 were repeated, with the difference that, instead of an anodized aluminum support, a copper-laminated polyimide sheet was employed, of the kind used for the production of flexible printed circuit boards in electronics.

In this case, it was not possible to charge the double layers with 0.5, 1.0 or 1.5 g/m² of precoat to the technically desired +500 V. These layers were therefore virtually unsuitable for use in practice. The coatings with precoats in the range from 2 g/m² to 4.5 g/m², however, gave charges of more than +500 V. It was possible then to obtain toner images with high resolution. These sheets could then be processed by decoating in the areas not covered by toner and removal of the metal areas located underneath by etching, to give high-grade flexible printed circuit boards.

A ratio of the thicknesses of the precoat over the topcoat is in the advantageous range between about 1:2 and about 3:1. Also, this example shows that, by the coating technique described, a mixing zone of at least 1.5 μm thickness was formed between the precoat and topcoat, which mixing zone is of decisive importance for the electrophotographic behavior of the double layer according to the present invention.

EXAMPLE 5

(Comparison example)

The coating of Example 2 was repeated, but with the difference that, in place of an anodized aluminum support, a copper-laminated polyimide sheet as in Example 4 was used.

The electrophotographic recording material thus produced could be charged only to less than +100 V and was therefore unsuitable for use in practice. It is presumed that "poisoning" of the photoconductor occurred on contact of the photoconductor solution with the copper surface.

The problem of the lack of chargeability of thin layers (6 g/m²) also rose in coating with other photoconductors, such as oxazole, pyrazoline and hydrazone derivatives, on copper-containing supports. A similar loss of electrostatic chargeability, though less pronounced, was also obtained in the case of coating on iron- and nickel-containing materials respectively. This reduction in charging could be counteracted by introducing a photoconductor-free precoat.

EXAMPLE 6

As a temporary support, a 75 μm thick polyester film was coated with a solution of 50 g of a sulfonylurethane, prepared by reacting a polyvinyl butyral with a quantity of propenylsulfonyl isocyanate which was equimolar (relative to free OH groups), according to German Offenlegungsschrift No. 32 10 577, Example 1, in 950 g of tetrahydrofuran, with the addition of 0.1 g of silicone oil.

The application of the solution was controlled in such a way that a dry layer weight of 3 g/m² resulted.

The following dispersion of a topcoat was applied (wet-on-wet coating) to the still-wet precoat:

50 g of a sulfonylurethane and 50 g of 2,5-bis-(4'-dimethylaminophenyl)-1,3,4-oxadiazole were dissolved in 900 g of tetrahydrofuran, with the addition of 0.1 g of silicone oil.

4 g of N,N'-dimethylperylene-3,4,9,10-tetracarboxylic acid diimide were dispersed in this solution within 2 hours by grinding in a ball mill.

The coating was dried for about 30 seconds at 60° C. and then for about 120 seconds at 100° C. Under these conditions, a defined mixing zone between the two layers was obtained. The dry layer weight of the double layer was 6 g/m².

Subsequently, the double layer was transferred in a laminator at 120° C. to a copper-laminated epoxy printed circuit board. The electrophotographic recording material thus produced had high charging capacity and excellent light sensitivity. It was negatively charged, exposed imagewise and treated with a liquid developer, and the resulting toner image was fixed by heating to 160° C. The toner image showed very good resolution. The image areas not covered by the toner were removed by means of an aqueous-alkaline decoater in accordance with the instructions in German Offenlegungsschrift No. 2,817,428, corresponding to U.S. Pat. No. 4,252,880, Example 1, and the bared copper areas were subsequently etched away. This gave a high-grade printed circuit board.

The light sensitivity of the recording material described above is so high that even exposure with a laser of low output power would suffice.

EXAMPLE 7

As a temporary support, a 75 μm thick polyester film was coated with a solution of 100 g of a sulfonylurethane, as in Example 6, in 900 g of tetrahydrofuran, with the addition of 0.1 g of silicone oil.

The coating was dried, the application of the solution being adjusted to a dry layer weight of 3 g/m².

Figure 4:
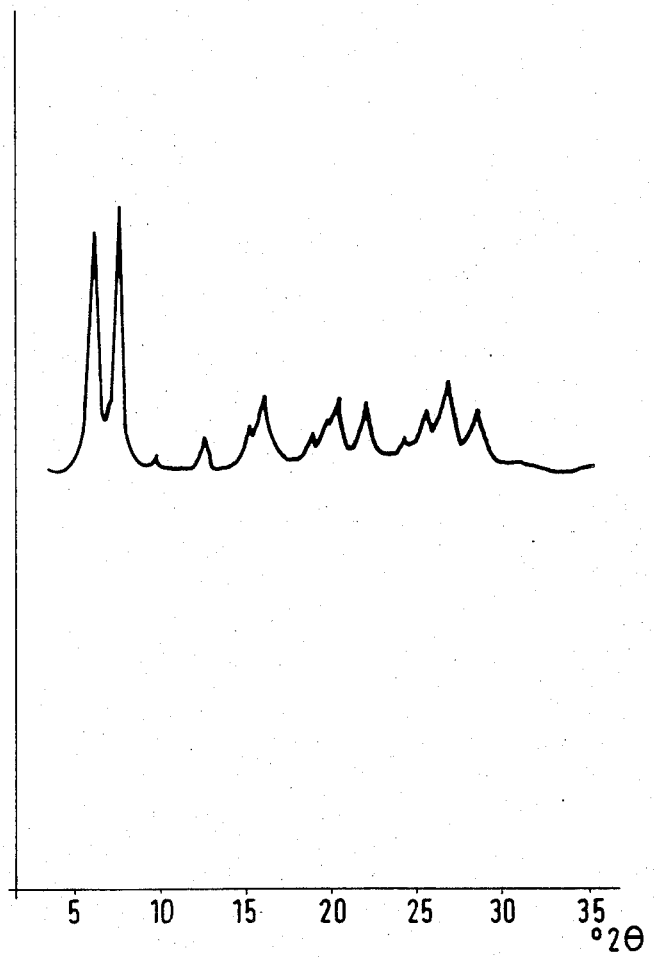
FIG. 4 shows the x-ray diffraction spectrum of a preferred constituent compound for the topcoat layer of an electrophotographic recording material within the present invention.

The following dispersion of a topcoat was applied to this precoat:

50 g of sulfonylurethane, as above, and 50 g of 2,5-bis-(4'-dimethylaminophenyl)-1,3,4-oxadiazole were dissolved in 700 g of tetrahydrofuran and
200 g of butyl acetate, with the addition of
0.1 g of silicone oil.
3 g of N,N'-dimethylperylene-3,4,9,10-tetracarboxylic acid diimide and
1 g of ε-copper phthalocyanine (Lionel Blue ERPC from Toyo Ink Manufacturing Co., Japan; its X-ray diffraction spectrum is shown in FIG. 4) were dispersed in the solution within 2 hours by grinding in a ball mill.

This layer was dried for about 30 seconds at 60° C. and then for about 120 seconds at 100° C. Under these conditions, a defined mixing zone between the two layers was obtained. The total dry layer weight was 6 g/m$^2$.

Subsequently, the double layer was transferred in a laminator at 120° C. from the temporary support to a bright aluminum foil. The electrophotographic recording material produced in this way showed high charging (see Table 1) and excellent panchromatic sensitivity with negative charging.

EXAMPLE 8

(Comparison example)

The procedure followed was that used in Example 7, with the difference that the order of the coatings was reversed and that the coating was applied directly to 75 μm-thick bright aluminum foil. The material thus obtained therefore corresponded in its layer structure—aluminum support, precoat and topcoat—to the recording material of Example 7. The comparison material had not even half the light sensitivity of the material of the present invention, exemplified in Example 7. This surprising difference in sensitivity is attributable to the unduly restricted formation of a mixing zone between the topcoat and precoat in the comparison material. Whereas the diffusible photoconductor is present in solution in Example 7 and can, therefore, readily penetrate into the partially swollen or redissolved precoat, in this example additionally the dissolution of the photoconductor in the precoat is necessary prior to its diffusion, which seams to be impossible within a feasible period of time.

EXAMPLE 9

The procedure followed was that used in Example 1, with the differences that a polyester film with vapor-deposited aluminum was used in place of the anodized aluminum support; that Hostaperm Orange GR (C.I. 71,105) was used instead of the N,N'-dimethylperylene-3,4,9,10-tetracarboxylic acid diimide; that 1,3-diphenyl-5-p-methoxyphenyl-pyrazoline was used instead of the 2,5-bis-(4'-dimethyl-aminophenyl-1,3,4-oxadiazole; and that a copolymer of styrene, methacrylic acid and hexyl methacrylate, in a monomer ratio of 10:30:60, was used intead of the copolymer of styrene and maleic anhydride.

EXAMPLE 10

(Comparison example)

The procedure followed was that used in Example 9, with the difference that, in the precoat, a mixture of 50 percent by weight of 2,5-bis-(4'-dimethyl aminophenyl)-1,3,4-oxadiazole and 50% of binder was used instead of the pure binder. As shown in Table 2, this difference was associated with an increase in sensitivity by a factor of 1.5, but at the same time the decoating rate was reduced by a factor of 3.

EXAMPLE 11

The procedure followed was that used in Example 9, with the differences that Hostaperm Scarlet GO (C.I. 59,300) was used instead of the Hostaperm Orange GR, and that the photoconductor used was p-methoxybenzaldehyde diphenylhydrazone.

The measured charging and sensitivity data are shown in Table 1.

EXAMPLE 12

An electrochemically roughened and anodized aluminum support, such as is used as a support for offset printing plates, was coated with a solution of:
50 g of a sulfonylurethane according to German Offenlegungsschrift No. 32 10 577, Example 1, in
950 g of tetrahydrofuran, with the addition of
0.1 g of silicone oil as well as
0.1 g of Rhodamine B (C.I. 45,170) dissolved in
1 g of methanol.

The coating was dried, and it had a dry layer weight of 3 g/m$^2$.

The following solution of a topcoat was applied to this precoat.
50 g of a sulfonylurethane and
50 g of 2,5-bis-(4'-dimethylaminophenyl)-1,3,4-oxadizole, dissolved in
900 g of tetrahydrofuran with the addition of
0.1 g of silicone oil as well as
0.1 g of rhodamine B (C.I. 45,170) dissolved in
10 g of methanol.

Drying was carried out in stages, as described in Example 1. The dry layer weight was about 6 g/m$^2$. The recording material thus prepared could be charged to +800 V, showed good light sensitivity, and, after imagewise exposure and toner application with a liquid developer, yielded images with very high resolution.

In a printing test, a printing plate prepared from this recording material, gave after fixing and stripping a run of more than 100,000 prints, with good halftone reproduction.

EXAMPLE 13

(Comparison example)

As in Example 12, a printing plate support was coated with a solution of
50 g of sulfonylurethane and
50 g of 2,5-bis-(4'-dimethylaminophenyl)-1,3,4-oxadiazole, dissolved in
900 g of tetrahydrofuran with the addition of
0.1 g of silicone oil as well as
0.5 g of Rhodamine B (C.I. 45,170) dissolved in
5 g of methanol, and was dried.

The dry layer weight was again about 6 g/m$^2$. The recording material thus prepared could be charged to +700 V and, despite twice the photoconductor content in the total layer as compared with Example 11, showed only a comparable light sensitivity.

When the printing plate described above was treated with an aqueous-alkaline decoater in a commercial decoating apparatus, the layer could be removed only slowly, due to its high content of insoluble photoconductor. The plate throughout was low. In contrast, the Example 11 recording material of the present invention could be decoated three times faster.

What is claimed is:

1. An electrophotographic recording material comprising an electrically conductive support and, disposed on said support, a photoconductive double layer which comprises a precoat layer and a topcoat layer adjacent to said precoat layer, (A) said precoat layer consisting essentially of a first insulating binder and (B) said topcoat layer comprising a second insulating binder which contains (i) between about 25 and about 60 weight-percent of at least one photoconductor and (ii) between about 0.5 and about 20 weight-percent of dye material, relative to said topcoat layer, said first and second insulating binders being identical, wherein the interface region of said precoat layer and said topcoat layer defines a mixing zone having a thickness of between about 1.5 and about 2 μm and into which at least one of said photoconductor and said dye material has diffused, said mixing zone being the product of a process comprising the steps of (1) applying said precoat layer to said support and (2) applying said topcoat layer to said precoat layer, so that partial redissolution of said precoat layer occurs to form at the interface region of said precoat and topcoat layers said mixing zone, into which at least one of said photoconductor and said dye material diffuses.

2. An electrophotographic recording material as claimed in claim 1, wherein the ratio of the thickness of said precoat layer to the thickness of said topcoat layer is between about 3:1 to about 1:10.

3. An electrophotographic recording material as claimed in claim 1, wherein said precoat layer further comprises up to about 0.5 weight-percent, relative to said precoat layer, of a dye material.

4. An electrophotographic recording material as claimed in claim 1, further comprising an insulating barrier layer interposed between said support and said photoconductive double layer.

5. An electrophotographic recording material as claimed in claim 1, wherein said dye material is dissolved or dispersed in said topcoat layer.

6. An electrophotographic recording material as claimed in claim 3, wherein said precoat layer comprising a dye material which is dissolved and dispersed in said precoat layer.

7. The electrophotographic recording material as claimed in claim 1, wherein at least one of said first and second insulating binders comprises a highmolecular substance which contains side groups conferring solubility in alkali.

8. The electrophotographic recording material as claimed in claim 1, wherein said photoconductive double layer was transferred from a temporary support to said support.

9. An electrophotographic recording material as claimed in claim 8, wherein said support was provided with an insulating barrier layer before transfer of said photoconductive double layer from said temporary support.

10. The recording material as claimed in claim 1, wherein said dye material comprises at least one selected from the group consisting of a perylene-3,4,9,10-tetracarboxylic acid derivative, a metal-containing phthalocyanine, a perinone, a fused quinone, a rhodamine dye, a cyanine dye, and a triarylmethane dye.

11. The recording material as claimed in claim 10, wherein said dye material comprises at least one selected from the group consisting of N,N'-dimethylperylene-3,4,9,10-tetracarboxylic acid diimide (C.I. 71,130), a metal-containing phthalocyanine (C.I. 74,160), Hostaperm Orange GR (C.I. 71,105), and Hostaperm Scarlet GO (C.I. 59,300).

12. The recording material as claimed in claim 10, wherein said dye material comprises at least one selected from the group consisting of Rhodamine B (C.I. 45,170), Astrazone Orange R (C.I. 48,040), and Brilliant Green (C.I. 42,040).

13. The recording material as claimed in claim 1, wherein said support comprises a metal plate or a metallized plastic film.

14. The recording material as claimed in claim 13, wherein said support comprises an aluminum plate which has been electrochemically roughened and anodized.

15. The recording material as claimed in claim 13, wherein said support comprises a copper-laminated polyimide film.

16. The recording material as claimed in claim 1, wherein said photoconductor is at least one selected from the group consisting of an oxadizole, an oxazole, a pyrazoline, a triazole, a imidazole, and a hydrazone.

17. The recording material as claimed in claim 16, wherein said photoconductor comprises 2,5-bis-(4'-dialkylaminophenyl)-1,3,4-oxadiazole.

18. The recording material as claimed in claim 16, wherein said photoconductor comprises p-methoxybenzaldehyde diphenylhydrazone.

19. The recording material as claimed in claim 16, wherein said photoconductor comprises 1,5-diphenyl-3-p-methoxy-phenyl-pyrazoline.

20. The recording material as claimed in claim 2, wherein said ratio is between about 2:1 and about 1:3.

21. The recording material as claimed in claim 7, wherein at least one of said first and second insulating binders comprises at least one from the group consisting of a copolymer of styrene and maleic anhydride, a sulfonylurethane, and a copolymer of acrylic acid and/or methacrylic acid.

22. A recording material as in claim 1, wherein said precoat layer is photoconductor-free.

23. A recording material as in claim 1, wherein said substrate comprises a copper surface to which said first layer is applied.

24. A recording material as in claim 1, wherein said substrate comprises an iron- or nickel-containing material.

25. A recording material as in claim 1, wherein said step (2) of applying said topcoat layer to said precoat layer comprises drying said topcoat layer to solidity in a stepwise fashion.

26. A recording material as in claim 23, wherein said drying is carried out in at least a first stage and a second stage which differ in temperature, duration, or temperature and duration, both of said first and second stages having (i) a temperature ranging from about room temperature to about 130° and (ii) a duration between about 5 and about 30 seconds.

27. A recording material as in claim 1, wherein both said dye and said photoconductor have diffused into said mixing zone.

28. A process for producing an electrophotographic recording material, comprising the steps of (A) applying to an electrically conductive support a precoat layer consisting essentially of a first insulating binder and (B) to said precoat layer, applying a topcoat layer comprising a second insulating binder which contains (i) between about 25 and about 60 weight-percent of at least one photoconductor and (ii) between about 0.5 and about 20 weight-percent of dye material, relative to said topcoat layer, said first and second insulating binders being identical, such that partial redissolution of said precoat layer occurs to form at the interface region of said precoat and topcoat layers a mixing zone having a thickness of between about 1.5 and about 2 μm, and into which at least one of said photoconductor and said dye material has diffused.

29. A process as claimed in claim 28, wherein said precoat layer further comprises up to about 0.5 weight-percent, relative to said precoat layer, of a dye material.

30. A process as claimed in claim 28, wherein step (B) comprises drying said topcoat layer to solidity in a stepwise fashion.

31. A process as claimed in claim 30, wherein said drying is carried out in at least a first step and a second stage which differ in temperature, duration, or temperature and duration, both of said first and second stages having (i) a temperature ranging from about room temperature to about 130° C. and (ii) a duration between about 5 and about 30 seconds.

32. A process as in claim 28, wherein step (B) comprises diffusion of both said dye and said photoconductor into said mixing zone.

* * * * *